US005383409A

United States Patent [19]

Hayakawa

[11] Patent Number: 5,383,409

[45] Date of Patent: Jan. 24, 1995

[54] CORRUGATED BOARD PALLET

[76] Inventor: Hiroshi Hayakawa, 4-42-1, Daisawa, Setagaya-ku, Tokyo, 155, Japan

[21] Appl. No.: 82,697

[22] Filed: Jun. 28, 1993

[30] Foreign Application Priority Data

Jun. 30, 1992 [JP] Japan ..... 4-045515[U]

[51] Int. Cl.[6] ..... B65D 19/00

[52] U.S. Cl. ..... 108/51.3

[58] Field of Search ..... 108/56.1, 51.3, 51.1

[56] References Cited

U.S. PATENT DOCUMENTS

| | | | |
|---|---|---|---|
| 2,544,743 | 3/1951 | Vrabcak | 108/51.3 |
| 3,308,772 | 3/1967 | Thomas, Jr. | 108/51.3 |
| 4,039,708 | 8/1977 | Okada | 108/51.3 X |
| 4,303,020 | 12/1981 | Houle | 108/51.3 |
| 4,391,202 | 7/1983 | Carter et al. | 108/51.3 |
| 4,966,084 | 10/1990 | Motomaru | 108/51.3 |
| 5,195,440 | 3/1993 | Gottlieb | 108/51.3 |

FOREIGN PATENT DOCUMENTS

| | | | |
|---|---|---|---|
| 2730879 | 1/1979 | Germany | 108/53.1 |
| 62-36741 | 9/1987 | Japan . | |

*Primary Examiner*—Jose V. Chen

*Attorney, Agent, or Firm*—Lowe, Price, LeBlanc & Becker

[57] ABSTRACT

A corrugated board pallet with considerable strength and simple structure. The corrugated board pallet includes: a structural reinforcing member constructed from corrugated board sheet; structural reinforcing bends formed by bending the structural reinforcing member, axes of the structural reinforcing bends in parallel with the direction that forks of a forklift vehicle are inserted in the pallet; a load carrying member constructed from corrugated cardboard sheet, the load carrying member fixed to an upper surface of the structural reinforcing member, wherein the direction that waves of the corrugated board forming the structural reinforcing member, and the load carrying member are in parallel with the direction that the forks of the forklift vehicle insert into the pallet.

7 Claims, 4 Drawing Sheets

CORRUGATED BOARD PALLET

BACKGROUND OF THE INVENTION

1. Field of the Invention

The present invention relates to a corrugated board pallet, and more particularly to a pallet constructed from corrugated board sheet such as cardboard for the purpose of storing, loading and unloading industrial products.

2. Description of the Prior Art

Various types of pallets constructed from wood, synthetic resin, metal, or the like have been used to lift and transport industrial products such as common appliances and light-weight machinery by using a forklift vehicle.

In order to conserve natural and economic resources and in response to the difficulty with the disposal of used pallets as industrial waste, in recent years, pallets constructed from corrugated cardboard have gradually been used in place of the pallets constructed from wood, synthetic resin, and metal.

The corrugated cardboard pallet has many advantages over the conventional wooden, synthetic resin, or metal pallet in that shock caused by vibration or falling can be absorbed; the pallet can be reused until worn out; the pallet can be recycled in cases where reuse is difficult or impossible to conserve natural and economic resources; the pallet can easily be disposed as industrial waste and energy for the disposal can be saved; and the weight of the pallet is reduced; and the damage common to other types of pallets by noxious insects and the breeding of bacterium can be reduced; and connecting parts such as nails, bolts and nuts are unnecessary, reducing the possibility of human body injury.

The construction of a pallet using a corrugated cardboard sheet has been proposed in Japanese Patent Publication (Examined) No. Showa 62-36741.

In the conventional pallet disclosed by the document mentioned above, a load carrying member is formed by bending a corrugated cardboard sheet with parallel fork channel bends are formed in the bottom side of the load carrying member in the direction that the forks of a forklift vehicle insert, and a pair of horizontal wooden stiffening planks situated toward the front and rear of the load carrying member perpendicular to the fork channel bends. The pair of wooden stiffening planks extend to both sides of the pallet and attach to the bottom side of the upper surface of the load carrying member. Further, cylindrical supports are located between the wooden stiffening planks and lower surface of the structural reinforcing bends.

In the case of pallets constructed with the structure described above, the wave of the corrugated cardboard which forms channel shaped fork channel bends in the load carrying member in parallel with the direction that the forks of the forklift vehicle insert, and the stiffness of the load carrying member is insufficient. As a result, when a heavy load is applied, the load carrying member can not bear the load so that the center of the load carrying member is prone to collapse. Further, when lifted and transported by the forklift vehicle, the load carrying member bends downward at both ends due to the load on the pallet and forms an arch at the center of the load carrying member, which may also cause the load carrying member to collapse.

Further, the structure of the pallet is rather complicated, the number of manhours required to assemble the pallet is rather high, and the assembly requires many parts, and the number of parts for the pallet increases, resulting in a high production cost.

SUMMARY OF THE INVENTION

The object of the present invention is to provide a corrugated cardboard pallet with increased strength, reduced assembly work and a decreased number of parts required for assembly of the pallet, resulting in a decrease of both the material cost and the production cost of the pallet. These objects in turn make the corrugated cardboard pallet suitable for mass production so that the production cost thereof may be further reduced.

The corrugated cardboard pallet according to the present invention comprises: a structural reinforcing member constructed from corrugated cardboard sheet; structural reinforcing bends formed in the structural reinforcing member in parallel with the direction that the forks of a forklift vehicle insert into the pallet; a load carrying member constructed from corrugated cardboard sheet fixed to the top side of the structural reinforcing member, wherein the direction that waves of the corrugated cardboard forming the structural reinforcing member, and the load carrying member are parallel with the direction that the forks of the forklift vehicle are inserted.

BRIEF DESCRIPTION OF THE DRAWINGS

The present invention will be clarified by the detailed description below with reference to the accompanying drawings wherein.

DETAILED DESCRIPTION OF PREFERRED EMBODIMENTS

A corrugated cardboard pallet according to the first embodiment of the present invention will be explained with reference to FIGS. 1 to 4.

In the figures, a structural reinforcing member 1 includes structural reinforcing bends 2 with a trapezoidal cross-section formed by bending a corrugated cardboard sheet S. In the first embodiment of the present invention, one structural reinforcing bend 2 is located at each side of the structural reinforcing member 1 and two structural reinforcing bends 2 are positioned around the central of the structural reinforcing member 1.

Figure 1:
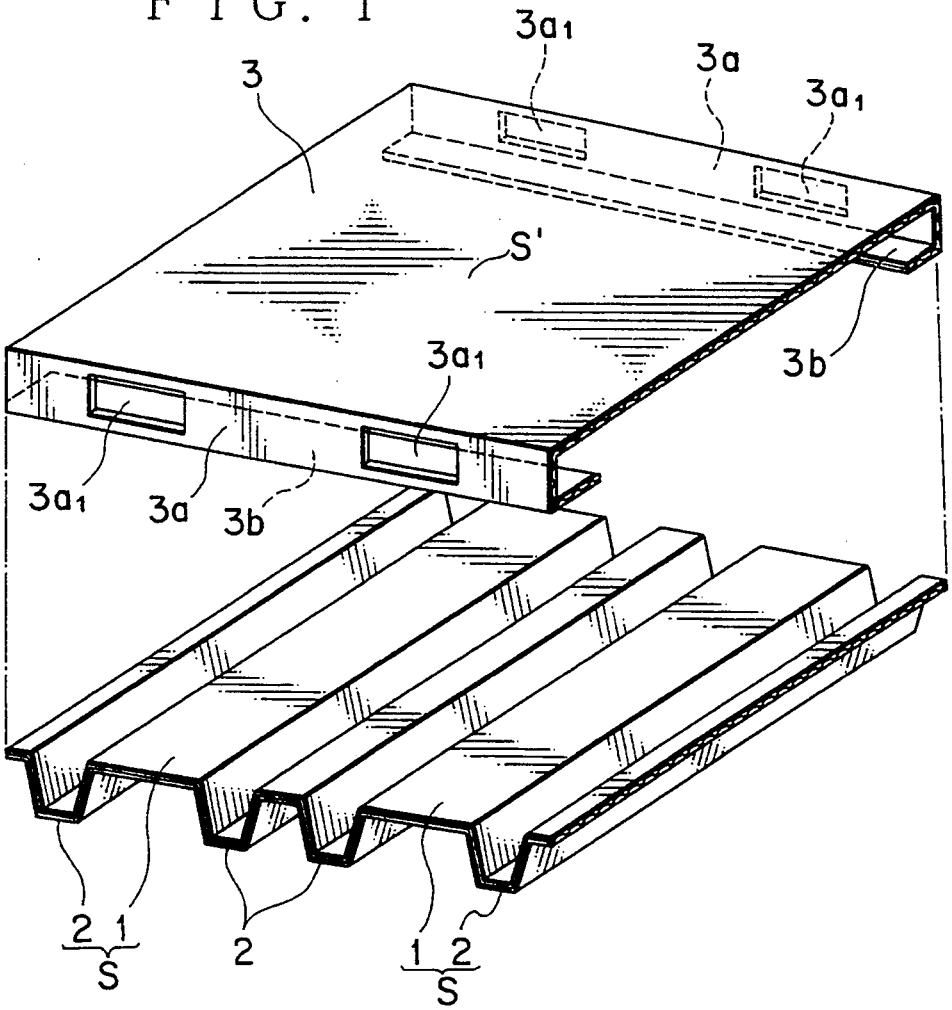
FIG. 1 is an exploded perspective view of a corrugated cardboard pallet according to a first embodiment of the present invention.

In FIG. 1, the corrugated cardboard sheet S is arranged so that the wave of the corrugated cardboard sheet S is in parallel with the direction that the forks of the forklift vehicle insert into the pallet. Further, in order to increase the strength and stiffness of the pallet, a plurality of corrugated fiberboard sheets may be adhered together to form the corrugated cardboard sheet S and used to make the structural reinforcing member 1.

Figure 2:
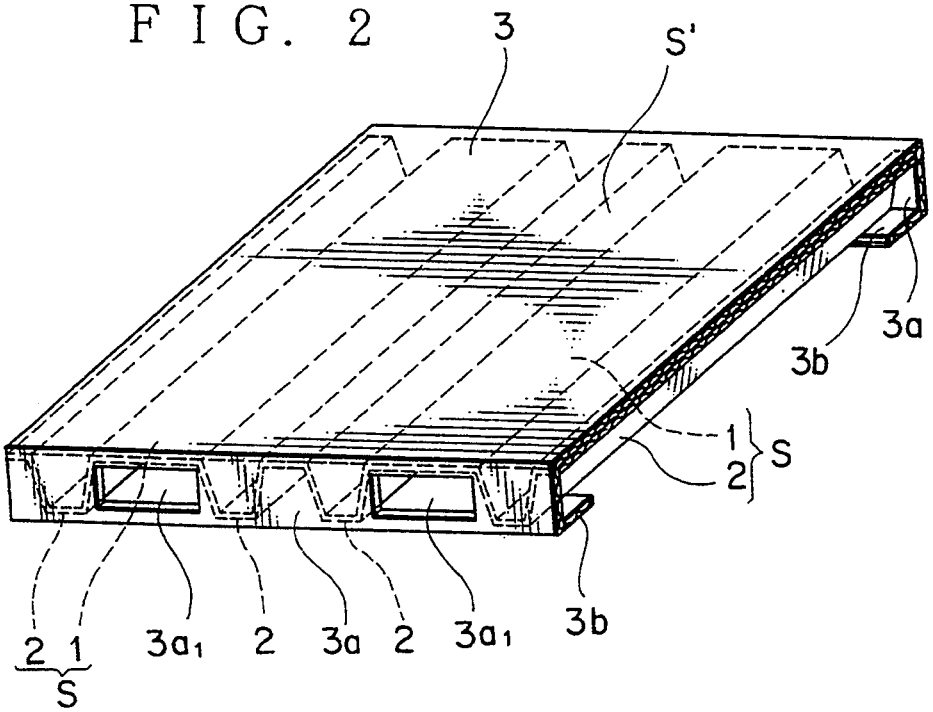
FIG. 2 is a perspective view of the corrugated cardboard pallet assembled according to the first embodiment of the present invention.
Figure 3:
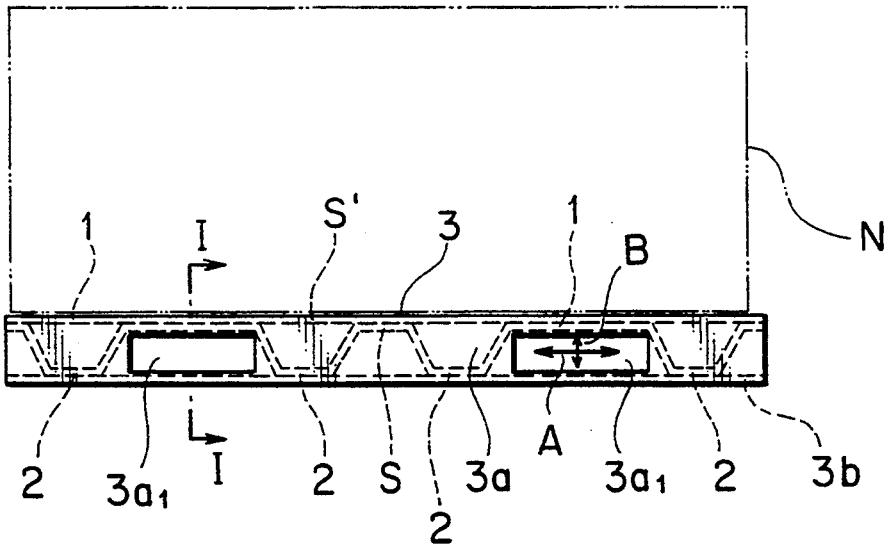
FIG. 3 is a front view of the assembled corrugated cardboard pallet in FIG. 2.
Figure 4:
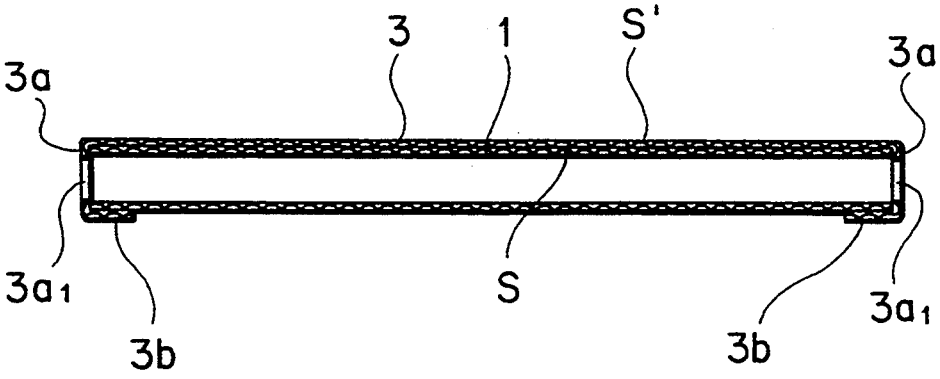
FIG. 4 is a cross-sectional side view of the corrugated cardboard pallet taken along the line I—I as noted in FIG. 3.

A load carrying member 3 is fixed to the upper surface of the structural reinforcing member 1 as illustrated in FIGS. 2 to 4. The load carrying member 3 is bent at the front and rear end portions to cover both ends of the structural reinforcing bends 2. The load carrying member 3 includes vertical receiving plates 3*a* with openings 3*a*1 through which the forks of the forklift vehicle are inserted, and integral feet 3*b* which are positioned across the structural reinforcing bends 2 at both ends of the structural reinforcing member 1.

The wave of the corrugated cardboard S′ used to fashion the load carrying member 3 is parallel with the direction that the forks of the forklift vehicle are inserted to the pallet in the same manner as the corrugated cardboard sheet S. In other words, the corrugated cardboard is arranged such that lines formed by the tops and bottoms of the waves are perpendicular to the direction that the forks of the forklift vehicle insert. As a result, the corrugated cardboard sheet S′ substantially contributes to the strength and stiffness of the pallet in combination with the corrugated cardboard sheet S against a load N applied in the middle of the load carrying member 3 and supports the load steadily preventing the load carrying member 3 from bending.

As illustrated in FIGS. 1 to 3, the structural reinforcing bends form a trapezoidal cross-section, and the ends of the structural reinforcing bends are covered by the vertical receiving plates 3*a* of the load carrying member 3. Feet 3*b* wrap around the ends of the lower horizontal plane of the structural reinforcing bends 2 with the surface of the feet 3*b* adhered in parallel with the load carrying member 3 to the bottom sides of the structural reinforcing bends 2 supporting the structure of the reinforcing bends in all three directions. When the load N is applied to the load carrying member 3 the pallet does not bend in the lateral direction A nor is it depressed in the vertical direction B as a result of the stiffness provided by the load carrying member 3 and the feet 3*b*, and the shape of the structural reinforcing bends 2 is maintained.

In the above embodiment, common appliances or light-weight machinery are preferably loaded on the load carrying member 3. However, other industrial products can also be handled by the corrugated cardboard pallet.

The shape of the trapezoid is determined, for example, such that the upper side is 9 cm, bottom side 3 cm, and the height 10 cm, which provides a stable structure to support the load N.

In order to fix the load carrying member 3 to the structural reinforcing member and the structural reinforcing bends 2 as illustrated in FIGS. 1 and 2, U-shaped locking pieces on sale or an adhesive agent is preferably used to securely adhere the surface of the corrugated cardboards to each other.

According to the first embodiment of the present invention, the wave of the corrugated cardboard S and S′ are in parallel with the direction that the forks of the forklift vehicle insert into the pallet. In other words, the corrugated cardboard is arranged such that lines formed by the tops and bottoms of the waves are perpendicular to the direction that the forks of the forklift vehicle insert. As a result, the corrugated cardboard sheet S′ provides large strength and stiffness in combination with the corrugated cardboard sheet S against the load N applied in the middle of the load carrying member 3 and supports the load steadily preventing the load carrying member 3 from bending.

The structural reinforcing bends 2 are formed with a trapezoidal cross-section with the receiving plates 3*a* and the feet 3*b* wrapped around and adhered to the ends of the structural reinforcing bends 2 at predetermined intervals creating a rigid structure.

When a load N is applied to the load carrying member 3, the load N is supported by the load carrying member 3, the structural reinforcing member 1 and the structural reinforcing bends 2 without deforming the load carrying member 3 or the structural reinforcing bends 2 in the lateral direction A or the vertical directions B.

When the pallet is lifted and transported by the forklift vehicle, the forks of the forklift vehicle are inserted into the openings 3*a*1 in the space between the structural reinforcing bends 2 of the structural reinforcing member 1. The size and shape of the openings 3*a*1 in the receiving plates 3*a* are designed protect the load carrying member 3 and the structural reinforcing member 1.

In the first embodiment of the present invention as described above, the structural reinforcing bends 2 are formed with a trapezoidal section. However, alternate shapes of the structural reinforcing bends may be chosen to stably support the load N on the load carrying member 3. For example, V-shaped structural reinforcing bends with a substantially regular triangle pattern may be adhered to the load carrying member 3 to provide considerable rigid support for the load N.

According to the first embodiment of the present invention as described above, one structural reinforcing bend 2 is located at each side of the structural reinforcing member 1 and two structural reinforcing bends are positioned around the center of the structural reinforcing member 1, and two openings 3*a*1 with channels for the forks of the forklift vehicle are formed between the structural reinforcing bends 2. However, the number of structural reinforcing bends and openings may be increased or decreased in accordance with the dimensions of the pallet and the maximum allowable load N.

Furthermore, in the above embodiment of the present invention, the ends of the load carrying member 3 are wrapped around and partially cover the bottoms of the structural reinforcing bends 2 forming the feet 3*b*. However, the size of the feet 3*b* may be enlarged to cover more or all of the bottom surface of the structural reinforcing member 1.

Figure 5:
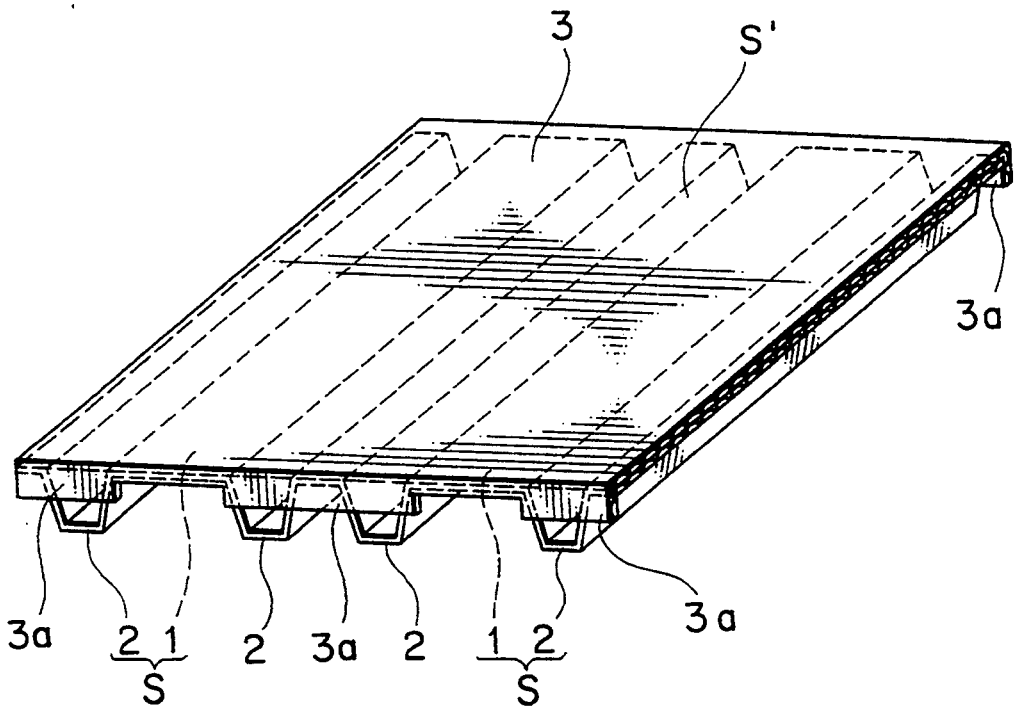
FIG. 5 is a perspective view of a corrugated cardboard pallet according to a second embodiment of the present invention.
Figure 6:
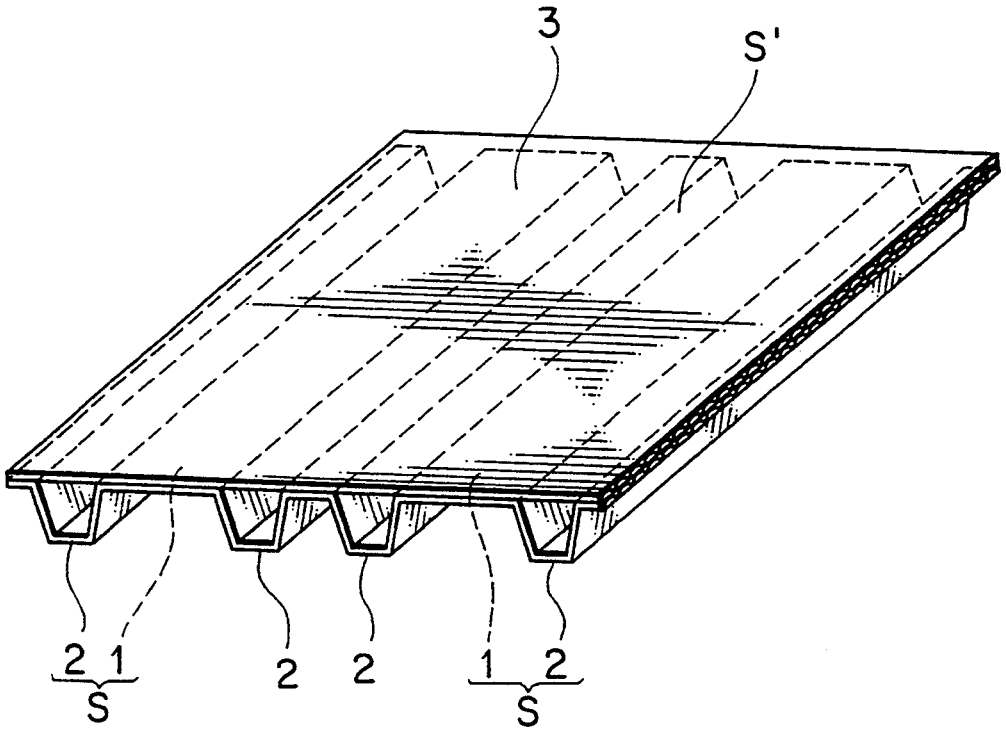
FIG. 6 is a perspective view of a corrugated cardboard pallet according to a third embodiment of the present invention.
Figure 7:
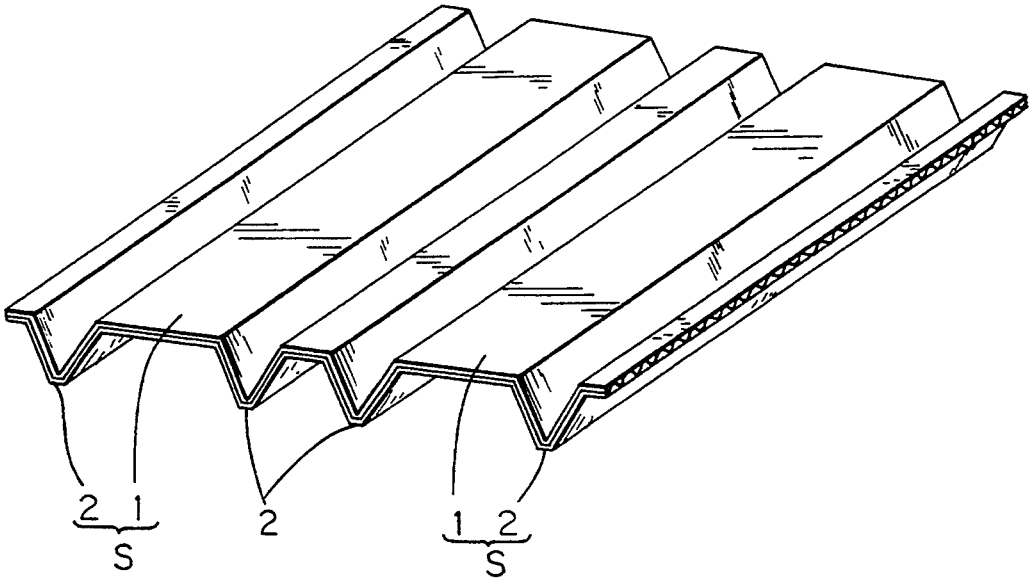
FIG. 7 is a perspective view of a structural reinforcement member having V-shaped structural reinforcing bends according to one embodiment of the present invention.

In the above embodiment, the ends of the structural reinforcing bends 2 are totally covered by the receiving plates of the load carrying member 3 and the bottom surface of the structural reinforcing member 1 are partially covered by the feet 3*b*. However, the bottom surface of the structural reinforcing member 1 is not required to be covered by the feet 3*b* and the receiving plate 3*a* may only partially cover the ends of the structural reinforcing bends 2 as illustrated in FIG. 5, or may include only the top surface of the load carrying member, as illustrated in FIG. 6.

These alternative embodiments help to simplify the structure of the pallet 'and'to decrease the number of parts, the production time and the production cost thereof.

According to the first embodiment of the present invention, the structural reinforcing member 1 and the load carrying member 3 are constructed from corrugated cardboard sheets, but the invention could easily be constructed from other materials such as corrugated plastic board sheets or wax coated corrugated cardboard sheet to improve the durability, water resistance, and other characteristics of the pallet as needed.

As described above, the corrugated cardboard pallet according to the present invention comprises: a structural reinforcing member constructed from corrugated cardboard sheet; structural reinforcing bends formed by bending the structural reinforcing member, axes of the structural reinforcing bends in parallel with the direction that forks of a forklift vehicle insert into the pallet; a load carrying member constructed from corrugated cardboard sheet, bottom side of the upper surface adhered to the top side of the structural reinforcing member, wherein the direction that waves of the corrugated cardboards forming the structural reinforcing member, and the load carrying member are parallel with the direction that the forks of the forklift vehicle insert.

As a result, the strength of the corrugated cardboard according to the present invention is increased, the assembly time and the number of parts for the pallet can be reduced, thereby lowering the production cost and material cost of the pallet.

What is claimed is:

1. A corrugated board pallet comprising:

a structural reinforcing member constructed from a corrugated board sheet, said structural reinforcing member having an upper surface and a first and a second end;

a plurality of parallel structural reinforcing bends formed in said structural reinforcing member, said plurality of structural reinforcing bends defining channels which extend below said upper surface of said structural reinforcing member said channels extending from said first end to said second end;

a load carrying member made of a corrugated board sheet, said load carrying member connected to said upper surface of said structural reinforcing member and including opposing end portions which are bent to form receiving plates, which entirely cover said first and second of the structural reinforcing bends, and feet which cover at least a portion of a bottom side of the structural reinforcing member and are fixed thereto; and openings in the receiving plates for receiving forks of a forklift vehicle.

2. A corrugated board pallet as claimed in claim 1, wherein said channels defined by said structural reinforcing bends have a trapezoidal cross-section.

3. A corrugated board pallet as claimed in claim 1, wherein said channels defined by said structural reinforcing bends have a V-shaped cross-section.

4. A corrugated board pallet as claimed in claim 1, wherein said structural reinforcing member comprises corrugated cardboard.

5. A corrugated board pallet as claimed in claim 1, wherein said load carrying member comprises corrugated cardboard.

6. A corrugated board pallet as claimed in claim 1, wherein said structural reinforcing member comprises plastic.

7. A corrugated board pallet as claimed in claim 1, wherein said load carrying member comprises plastic.

* * * * *